US009873183B2

(12) United States Patent
Ri et al.

(10) Patent No.: US 9,873,183 B2
(45) Date of Patent: Jan. 23, 2018

(54) MANUFACTURING METHOD OF ROTARY GRINDSTONE AND ROTARY GRINDSTONE WHICH HAS BEEN MANUFACTURED BY THE MANUFACTURING METHOD

(71) Applicant: FUJI GRINDING WHEEL MFG. CO., LTD, Higashiosaka (JP)

(72) Inventors: Gakusho Ri, Higashiosaka (JP); Yoshikazu Yanagiura, Higashiosaka (JP)

(73) Assignee: Fuji Grinding Wheel Mfg. Co. LTD, Osaka (JP)

( * ) Notice: Subject to any disclaimer, the term of this patent is extended or adjusted under 35 U.S.C. 154(b) by 0 days.

(21) Appl. No.: 14/455,270

(22) Filed: Aug. 8, 2014

(65) Prior Publication Data

US 2015/0314422 A1 Nov. 5, 2015

(30) Foreign Application Priority Data

Apr. 30, 2014 (JP) ..... 2014-093283

(51) Int. Cl.

| | |
|---|---|
| ***B24D 3/28*** | (2006.01) |
| ***B24D 5/04*** | (2006.01) |
| ***B24D 18/00*** | (2006.01) |
| ***B24D 7/04*** | (2006.01) |
| ***B24D 5/12*** | (2006.01) |

(52) U.S. Cl.

CPC ..... *B24D 5/04* (2013.01); *B24D 3/28* (2013.01); *B24D 5/12* (2013.01); *B24D 7/04* (2013.01); *B24D 18/0009* (2013.01); *B24D 18/0027* (2013.01); *B24D 18/0072* (2013.01)

(58) Field of Classification Search

CPC ..... B24D 18/0009; B24D 18/0027; B24D 18/0072; B24D 7/04

USPC ..... 451/546; 51/298

See application file for complete search history.

(56) References Cited

U.S. PATENT DOCUMENTS 2,078,437 A * 4/1937 Anderson ..... B24D 5/04 15/DIG. 3

3,487,589 A * 1/1970 Binkley ..... B24B 27/06 451/541

(Continued)

FOREIGN PATENT DOCUMENTS

| | | |
|---|---|---|
| JP | 57-066863 | 4/1982 |
| JP | 2001-315063 | 11/2001 |

*Primary Examiner* — Larry E Waggle, Jr.
*Assistant Examiner* — Henry Hong
(74) *Attorney, Agent, or Firm* — Fattibene and Fattibene LLP; Paul A. Fattibene

(57) ABSTRACT

A problem solved is realizing a self-sharpening of a rotary grindstone in the most efficient manner and allowing sequential appearances of sharp cutting faces. To solve the problem, the invention provides a manufacturing method of a rotary grindstone 1 with one or more sheets of glass cloth 4 as a reinforcing material, wherein the glass cloth 4 is weaved by thirl plain weave/twill weave or leno weave composed of twist yarns having a diameter of 0.1 mm or less and formed in meshes with lengthwise and crosswise lengths of 2.0 mm or less, and attaching liquid resin to the glass cloth 4 to produce a prepreg 6, attaching resin-coat abrasive grains to both faces of the prepreg 6, and pressing the prepreg 6 in a press machine and further performing predetermined press working in a metal mold, performing baking.

5 Claims, 7 Drawing Sheets

(56) References Cited

U.S. PATENT DOCUMENTS

| | | | | | |
|---|---|---|---|---|---|
| 3,540,869 | A * | 11/1970 | Bauer | C08G 18/68 | 51/298 |
| 5,584,755 | A * | 12/1996 | Alfer | B24D 5/12 | 125/15 |
| 7,115,029 | B2 * | 10/2006 | Lang | B24D 5/16 | 451/544 |
| 2008/0302719 | A1 * | 12/2008 | Chikura | B01D 63/10 | 210/497.1 |
| 2010/0190424 | A1 * | 7/2010 | Francois | B24D 5/123 | 451/548 |
| 2012/0100784 | A1 * | 4/2012 | Klett | B24D 3/342 | 451/41 |
| 2012/0177911 | A1 * | 7/2012 | Kimura | C08J 5/24 | 428/323 |
| 2012/0289624 | A1 * | 11/2012 | Metral | C08G 59/066 | 523/400 |

* cited by examiner

MANUFACTURING METHOD OF ROTARY GRINDSTONE AND ROTARY GRINDSTONE WHICH HAS BEEN MANUFACTURED BY THE MANUFACTURING METHOD

TECHNICAL FIELD

The present invention relates to a manufacturing method of a rotary grindstone and a rotary grindstone which has been manufactured by the manufacturing method, and in particular to a manufacturing method of a rotary grindstone provided with glass cloth as a reinforcing material and a rotary grindstone which has been manufactured by the manufacturing method.

BACKGROUND ART

Conventionally, a rotary grindstone using glass cloth as a reinforcing material is widely known, but in particular, ones disclosed in Patent Literatures 1 and 2 are known as ones relating to the present invention.

A rotary grindstone disclosed in Patent Literature 1 is one using, as the reinforcing material, a nonwoven fabric of glass cloth having a plurality of warps arranged in parallel, a plurality of first oblique yarns obliquely intersecting the warps, and a plurality of second oblique yarns obliquely intersecting the warps from an opposite direction of the first oblique yarns.

Of course, the nonwoven fabric of the glass cloth is formed by performing impregnation of thermosetting rein to form a prepreg, laying out one sheet of the prepreg in a metal mold, further spreading mixture of abrasive grains with which liquid phenol resin is coated and powdery phenol resin in an even thickness, further stacking a sheet of the prepreg on an upper face of the mixture, and applying pressure from above. That is, the prepregs are arranged on upper and lower faces, and the abrasive grains layer is stacked therebetween so that compression molding is performed.

Next, a rotary grindstone disclosed in Patent Literature 2 will be described.

The rotary grindstone disclosed in the same Literature is a rotary grindstone where two or more layers of glass cloth have been provided inside or a surface of the rotary grindstone as the reinforcing material, wherein weaving directions of respective yarns in the glass cloth intersect each other at an angle of about 45° or 135°.

Therefore, the glass cloth is one manufactured by performing formation to prepregs with methanol-soluble phenol resin, sandwiching abrasive grains between the prepregs, and performing predetermined molding method.

PRIOR ART TECHNICAL LITERATURE

Patent Literature

Patent Literature 1: Japanese Patent Application Laid-Open No. 2001-315063

Patent Literature 2: Japanese Patent Application Laid-Open No. Sho57-66863

SUMMARY OF INVENTION

Problem to be Solved by Invention

Both the conventional rotary grindstones disclosed in the above Patent Literatures 1 and 2 are ones formed by stacking the prepregs and the abrasive grain layer, and improved in rotation breaking strength and impact strength, but the rotary grindstones involve such a drawback that self-sharpening cannot be efficiently expected during uses thereof.

That is, in a rotary grindstone, abrasive grains whose blade edge have been worn constantly generate new blades but when the new blades become unusable, the abrasive grains constituting the blades fall off and next new abrasive grains appear, but at an appearing time of the new abrasive grains, in the rotary grindstones disclosed in the above Patent Literatures 1 and 2, abrasive grains generally falls off as they are without the abrasive grains being chipped, so that sharp grinding blades cannot be formed.

Therefore, there is occurs a technical problem to be solved in order to be capable of expecting self-sharpening of a rotary grindstone most efficiently and allow appearance of sharp new blades to be capable of realizing a grinding action smoothly and accurately, and an object of the present invention is to solve the above problem.

Means for Solving Problem

The present invention has been proposed in order to achieve the above object, and the present invention provides a manufacturing method of a rotary grindstone having a central hole for fitting a shaft for grindstone rotation drive of a grinder and attaching liquid resin to one or a plurality of sheets of glass cloth used as a reinforcing material to form the prepreg, wherein the glass cloth is weaved by thirl plain weave/twill weave or leno weave composed of twist yarns having a diameter of 0.1 mm or less and formed in meshes with lengthwise and crosswise lengths of 2.0 mm or less, and the rotary grindstone is manufactured by, after attaching liquid resin to the glass cloth to produce a prepreg, attaching resin-coat abrasive grains to both faces of the prepreg; and next after pressing the prepreg formed with resin-coat abrasive grains layers on both faces of the prepreg in a press machine and performing predetermined press working using a metal mold or the like, performing baking in a baking furnace.

According to this manufacturing method, since the glass cloth is weaved by thirl plain weave/twill weave or leno weave using extremely thin twist yarns (diameter of 0.1 mm or less), it is possible to form the mesh to have lengthwise and crosswise lengths of 2.0 mm or less. Then, a rotary grindstone is manufactured by immersing the glass cloth in liquid resin to form a prepreg, next, attaching resin-coat abrasive grains from both faces of the prepreg to form resin-coat abrasive grains layers on the both faces of the prepreg, performing pressing in this state in a press machine and using a predetermined metal mold or the like. At this time, in a state where the resin-coat abrasive grains have been conjugated in respective meshes of the glass cloth, abrasive grains, resin constituting a binder and the glass cloth are bonded integrally.

Next, the invention described in another embodiment provides a rotary grindstone manufactured by the manufacturing method according to claim 1 in a manufacturing method of a rotary grindstone having a central hole for fitting a shaft for grindstone rotation drive of a grinder and provided with one or a plurality of sheets of glass cloth as a reinforcing material, wherein the glass cloth is weaved by thirl plain weave/twill weave or leno weave composed of twist yarns having a diameter of 0.1 mm or less and formed in meshes with lengthwise and crosswise lengths of 2.0 mm or less, and the rotary grindstone is manufactured by attaching liquid resin to the glass cloth to produce a prepreg, forming resin-coated film abrasive grains to both faces of the prepreg, and further performing predetermined press working or the like.

According to this configuration, in the rotary grindstone manufactured by the manufacturing method described in in an embodiment, when the prepreg is formed in a state where the glass cloth whose meshes are extremely fine (lengthwise and crosswise lengths of 0.2 mm or less) is immersed in liquid resin and the liquid resin does not harden, the resin-coat abrasive grains layers are formed on both faces of the prepreg, pressing is performed from the both faces, and the rotary grindstone is manufactured via a predetermined route such as metal mold forming or the like, the resin-coat abrasive grains are integrally bonded to the glass cloth in such a state that the resin-coat abrasive grains together with resin are conjugated in the fine meshes.

Effect of Invention

In the inventions described, since the glass cloth uses twist yarns of 0.1 mm or less, when it is weaved by thirl plain weave/twill weave or leno weave, the meshes with lengthwise and crosswise lengths of 2.0 mm or less can be formed. There, since liquid resin is attached to the glass cloth to form the prepreg, the prepreg itself has elasticity extremely to be prevented from being broken unintentionally and the above fine meshes are maintained. There, resin-coat abrasive grains are attached to both faces of the prepreg to form resin-coat abrasive grains layers. Then, the prepreg formed with the resin-coat abrasive grains layers is pressed by a pressing machine.

At this time, the unhardened liquid resin of the prepreg, the resin forming the resin-coats attached to the both faces of the prepreg, and abrasive grains utilizing the resin as a binder become mixed and integral, and respective abrasive grains are firmly conjugated in the respective fine meshes, so that the glass cloth and respective resins are bonded integrally as a whole.

Then, since the integrally bonded member is subjected to a finishing work via predetermined press working and braking work, in the rotary grindstone of the present invention, abrasive grains firmly conjugated in the meshes partially chip to grind a member to be ground during grinding of the member to be ground and simultaneously the chipped faces form sharp next cutting faces to perform the next grinding. By repeating such an operation, an extremely efficient self-sharpening can be expected in the rotary grindstone of this invention, and since abrasive grains chip so that sharp cutting faces appear, grinding resistance decreases and grinding heat generated between the member to be ground and the rotary grindstone is considerably low as compared with a conventional rotary grindstone.

Accordingly, a grinding efficiency is improved in grinding performed by the rotary grindstone of the present invention, such an event that grinding deflection and grinding crack of a member to be ground or precision failure of a ground face occur does not take place at all, extremely efficient self-sharpening can be expected, and since such a rotary grindstone can be formed in an extremely thin shape as compared with a conventional one, material is reduced and manufacture is performed efficiently by simple equipment.

EMBODIMENT FOR CARRYING OUT THE INVENTION

In order to achieve such an object that self-sharpening of a rotary grindstone can be expected highest efficiently and cutting faces formed by abrasive grains performing grinding action are sharp and can sequentially appear during grinding of a member to be ground, the present invention is realized by providing a manufacturing method of a rotary grindstone having a central hole for fitting a shaft for grindstone rotation drive of a grinder and attaching liquid resin to one or a plurality of sheets of glass cloth used as a reinforcing material to form the prepreg, wherein the glass cloth is weaved by thirl plain weave/twill weave or leno weave composed of twist yarns having a diameter of 0.1 mm or less and formed in meshes with lengthwise and crosswise lengths of 2.0 mm or less, and the rotary grindstone is manufactured by, after attaching liquid resin to the glass cloth to produce a prepreg, attaching resin-coat abrasive grains to both faces of the prepreg, and next after pressing the prepreg formed with the resin-coat abrasive grains layers on both faces of the prepreg in a press machine and performing predetermined press working using a metal mold or the like, and performing baking in a baking furnace.

EXAMPLE

Figure 1:
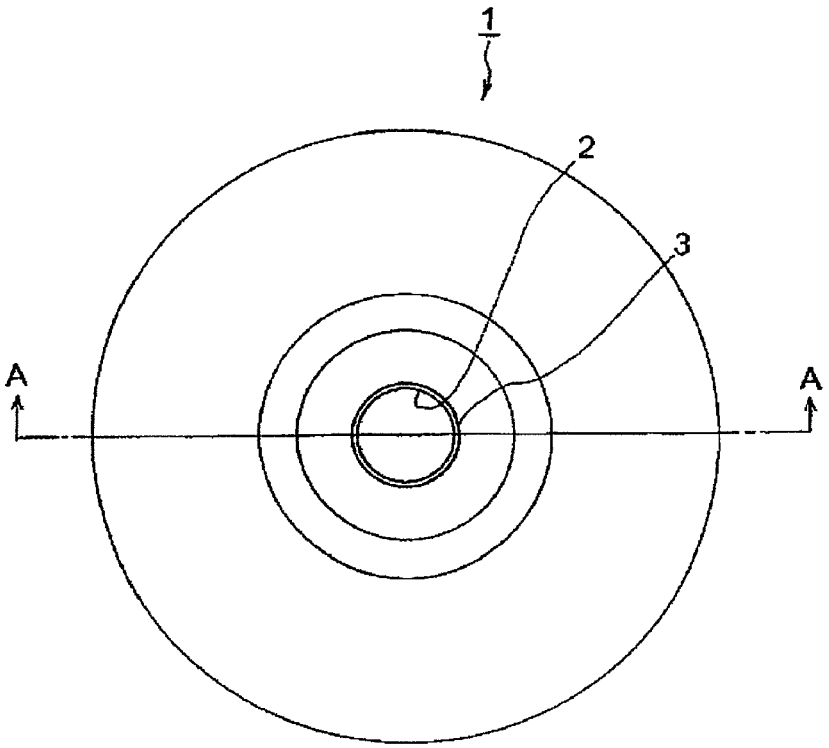
FIG. 1 is a plan view of a rotary grindstone according to an embodiment of the present invention.
Figure 2:
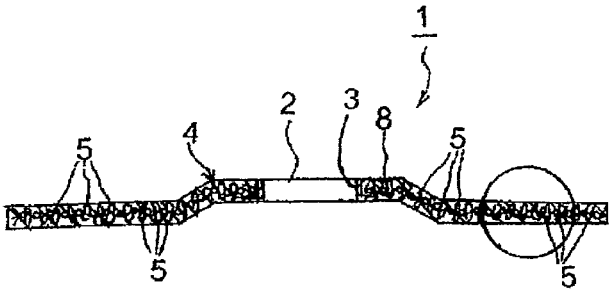
FIG. 2 is a sectional view taken along line A-A in FIG. 1.
Figure 3:
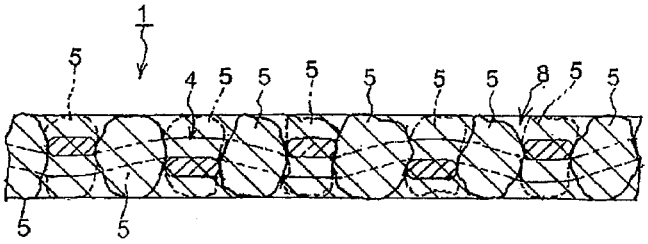
FIG. 3 an enlarged sectional view of inside of a circle in FIG. 2.

A preferred example of the present invention will be described in detail below with reference to FIG. 1 to FIG. 6. FIG. 1 to FIG. 3 show a rotary grindstone 1, FIG. 1 being a plan view thereof, FIG. 2 being a sectional view taken along line A-A in FIG. 1, and FIG. 3 being an enlarged sectional view of inside of a circle in FIG. 2. As shown in the same figures, the rotary grindstone 1 is configured such that a reinforcing ring 3 made of metal is fitted in a central hole 2 provided at a central portion of the rotary grindstone 1, a shaft of a rotary grindstone driving motor of a grinder or the like is fitted to the reinforcing ring 3, and the rotary grindstone 1 is rotationally driven to grind a member to be ground.

Figure 4:
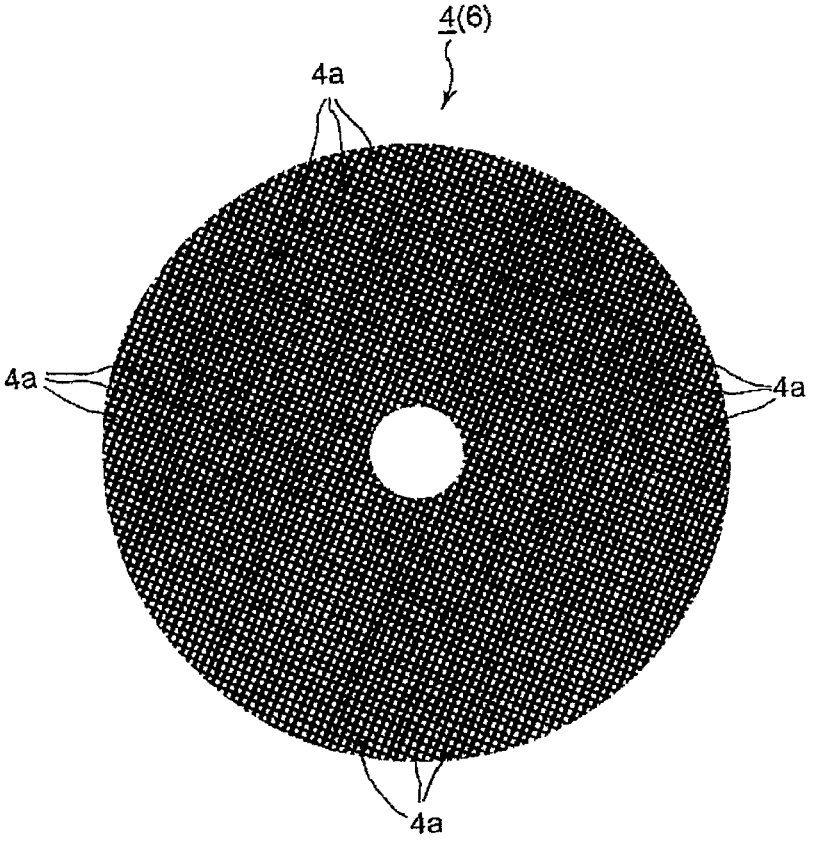
FIG. 4 is a plan view of a glass cloth according to the present invention.

Incidentally, the rotary grindstone 1 according to the present invention is manufactured via manufacturing steps described later, but one to be emphasized as one of the most important constituent elements in the present invention is a special configuration of glass cloth 4 provided as a reinforcing material. That is, as shown in FIG. 4, when the glass cloth 4 of the present invention is weaved by thirl plain weave/twill weave or leno weave using twist yarns having a diameter of 0.1 mm or less, it is possible to form respective lengthwise and crosswise lengths of meshes 4*a*, 4*a* . . . to 2.0 mm or less, respectively. Of course diameter of twist yarns is a diameter after having twisted out plural single yarn. Therefore, respective abrasive grains 5, 5 . . . can be firmly conjugated in the meshes 4*a*, 4*a* . . . integrally together with resin (including a binder for the abrasive grains 5, 5 . . . ) described later. If the meshes 4*a*, 4*a* . . . are made large, even if abrasive grains are present in the meshes, the respective abrasive grains are not firmly conjugated in the meshes. As described above, since the rotary grindstone 1 of the present invention is firmly conjugated in the respective meshes 4*a*, 4*a* integrally together with resin, respective abrasive grains 5, 5 . . . are chipped so that chipped faces form sharp next cutting faces.

Figure 5:
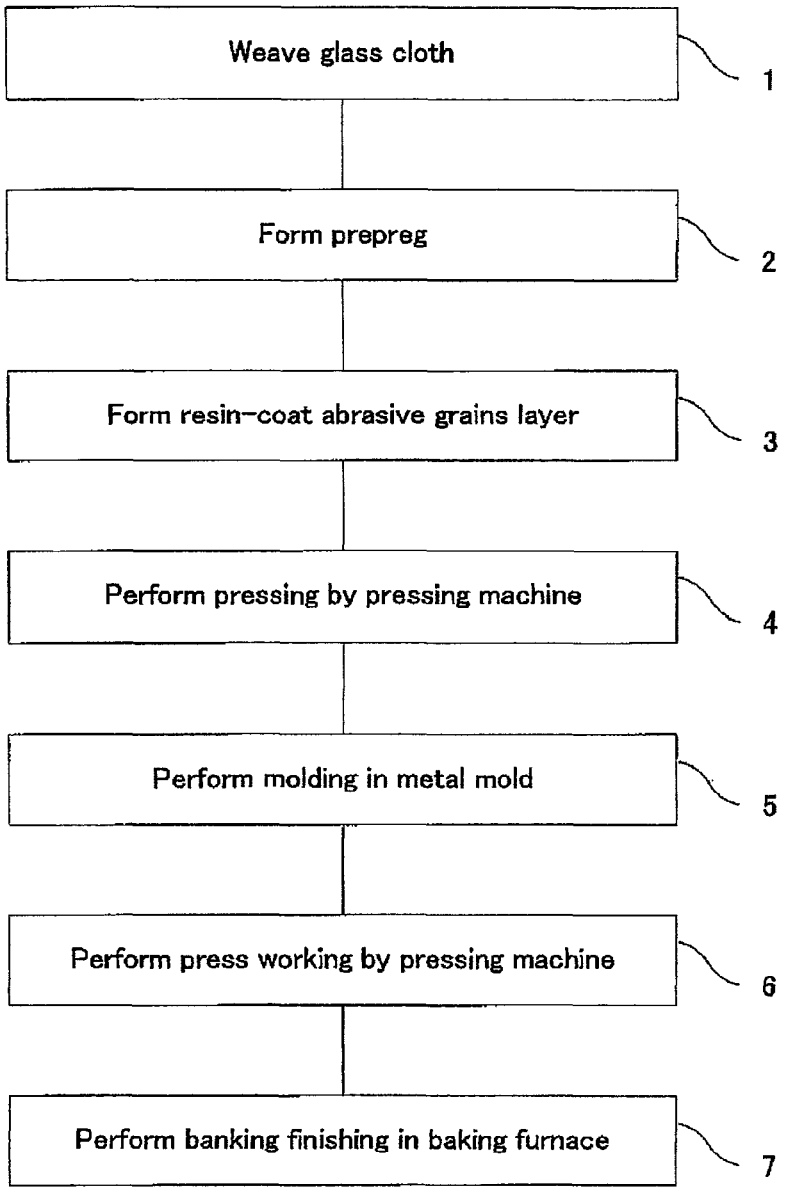
FIG. 5 is a flowchart of manufacturing steps of a rotary grindstone of the present invention.

Therefore, manufacturing steps of the rotary grindstone 1 of the present invention will be described according to a flowchart in FIG. 5. At step 1 in the same figure, in the rotary grindstone 1 of the present invention, the glass cloth 4 is first weaved as a reinforcing material. The glass cloth 4 is weaved by thirl plain weave/twill weave or leno weave using twist yarns having a diameter of 0.1 mm or less, but the meshes 4*a*, 4*a* . . . formed of warps and wefts are formed such that lengthwise and crosswise lengths of meshes 4*a*, 4*a* . . . are 2.0 mm or less. There, respective abrasive grains 5, 5 . . . can be firmly conjugated in the extremely small meshes 4*a*, 4*a* . . . , respectively. The glass cloth 4 thus configured is attached with liquid resin to be formed in prepreg 6 at step 2. Accordingly, the prepreg 6 is present in a state where the liquid resin is unhardened. Next, resin-coat abrasive grains layers are formed on both faces of the prepreg 6 at step 3.

In formation of the resin-coat abrasive grains layer, the resin-coat abrasive grains layer is formed by mixing the abrasive grains 5, 5 . . . and the resin serving as a binder to form resin abrasive grains and attaching the resin abrasive grains to both faces of the prepreg 6. Various methods such as the resin-coat abrasive grains is applied to both faces of the prepreg 6 by a brush, a spray gun is used, or spatula paining or an elastic roller is used are thought, but the resin-coat abrasive grains layers can be attached to the both faces of the prepreg even by either of the methods, and the attaching method is not specified. Next, at step 4, the prepreg 6 both faces of which have been attached with the resin-coat abrasive grains layers is pressed by a pressing machine. At this time, the respective abrasive grains 5, 5 . . . are formed in an extremely flat shape in a state where they have been wholly conjugated in either of the meshes 4*a*, 4*a* . . . integrally together with resin. Next, at step 5, formation to a predetermined shape is performed in a metal mold, pressurization is performed by a pressing machine at step 6, and baking finishing is performed in a baking furnace at step 7.

As a test result, it has been proven that a significant difference in performance is present between the rotary grindstone 1 of the present invention manufactured via the above steps and a comparative example which is said as a highest quality product.

Figure 7:
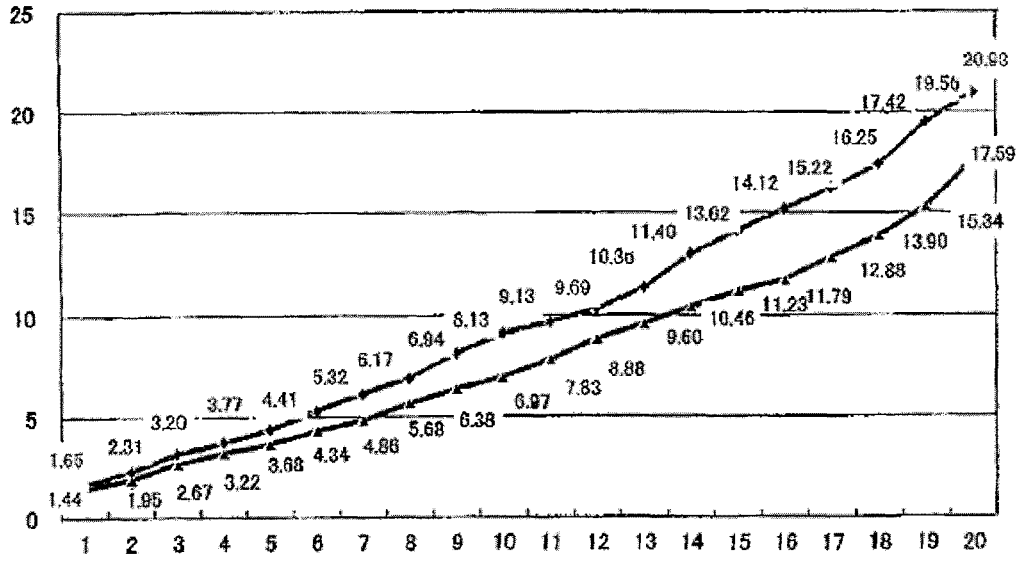
FIG. 7 shows a comparison between a comparison example and the rotary grindstone of the present invention.

FIG. 7 shows an example of comparison between a comparison example and the rotary grindstone of the present invention. An upper curve in FIG. 7 shows the comparative example, while a lower curve is a curve of the rotary grindstone of the present invention. That is, at test points of respective curves, rotation grindings of 20 rotations were performed for 5 minutes each, respectively and abrasion losses for 100 minutes were detected, respectively, and it was proven that a large difference in abrasion loss between the respective rotary grindstones is present between the comparative example and the rotary grindstone of the present invention, as shown in FIG. 7.

Figure 8:
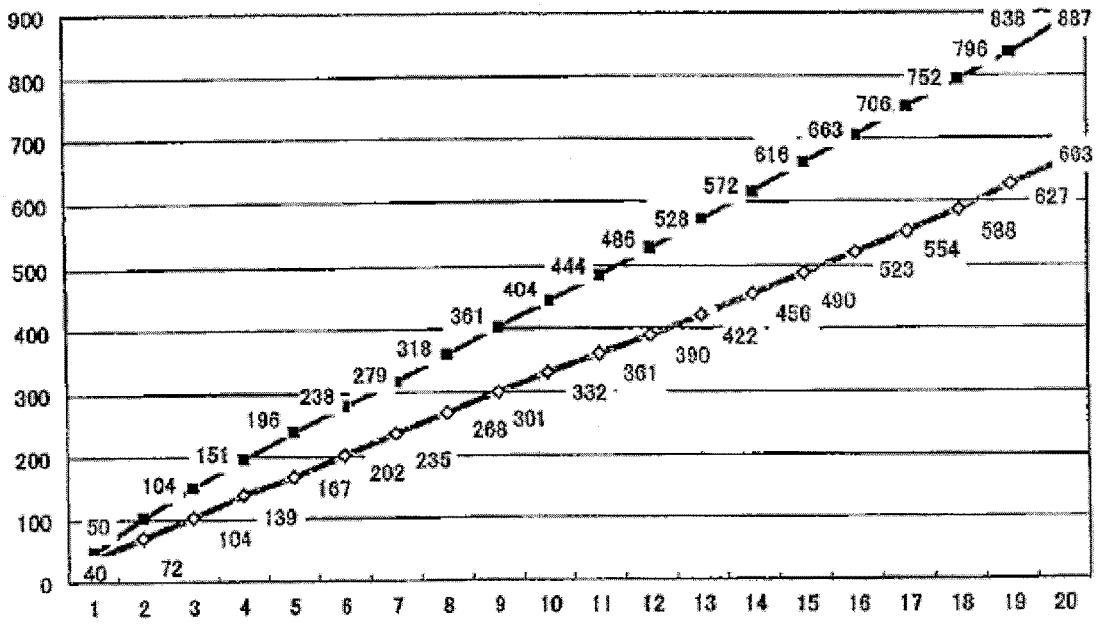
FIG. 8 shows sums of a grinding amount for 100 minutes of a comparative example and the present invention.

Further, sums of a grinding amount for 100 minutes of the above comparative example and the present invention are shown in FIG. 8. In FIG. 8, an upper curve shows a sum of a grinding amount of the rotary grindstone of the present invention, while a lower curve is a curve of a sum of a grinding amount of the comparative example.

As shown in FIG. 8, a considerably large difference in grinding amount is present between the rotary grindstone of the present invention and the comparative example under the same conditions, and excellence of the performance of the rotary grindstone of the present invention is proven.

From the graphs of FIG. 7 and FIG. 8, with used amounts of abrasive grains and a binder for the abrasive grains which are approximately half of those in the comparative example, the same performance can be achieved in the present invention, and contribution to cost reduction can be obtained by saving the material used amounts.

Therefore, a state where a member to be ground 7 is being ground by the rotary grindstone 1 of the present invention will be described with reference to FIG. 6. As shown in the same figure, a state where respective abrasive grains 5, 5 . . . have been firmly conjugated in the respective meshes 4*a*, 4*a* . . . integrally together with resin (this includes unhardened resin of the prepreg 6 and the resin 8 serving as a binder for abrasive grains 5, 5 . . . ), and the prepreg 6 has been also bound to the resin 8 integrally is shown. Incidentally, the same figure is for explaining the characteristics of the rotary grindstone 1 of the present invention.

Figure 6:
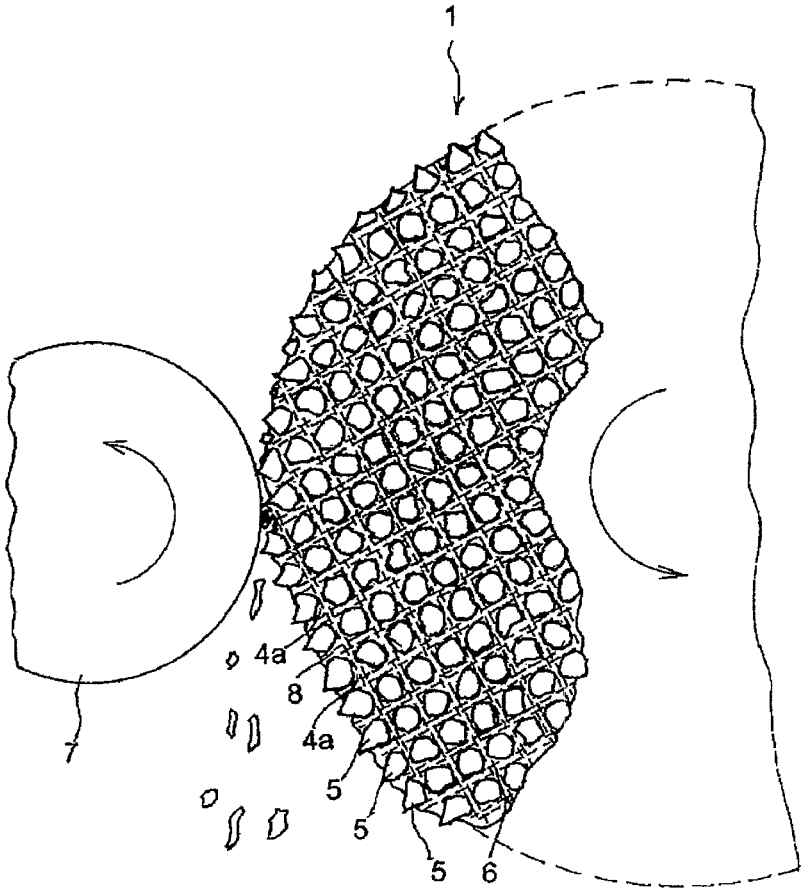
FIG. 6 is an explanatory diagram showing a state where a member to be ground is being ground by the rotary grindstone of the present invention.

As shown in FIG. 6, when the member to be ground 7 is ground by the rotary grindstone 1, respective abrasive grains 5, 5 . . . firmly conjugated in the meshes 4*a*, 4*a* . . . are chipped on their grinding faces, and next cutting faces are formed by the chipping. That is, since the chipped faces appear sharply just like nails, the member to be ground 7 can be ground extremely accurately, efficiently and rapidly, so that the self-sharpening of the rotary grindstone can be expected in the most efficient manner.

Of course, it is obvious that the rotary grindstone of the present invention improves rotation breaking strength and impact strength.

INDUSTRIAL APPLICABILITY

The rotary grindstone of the present invention can be utilized for not only grinding but also a manufacturing method of an offset-type rotary grindstone for polishing, a flat rotary grindstone for cutting, and the like.

Incidentally, the present invention can be modified variously without departing from the scope of the present invention, and the present invention reaches modified ones, of course.

EXPLANATION OF REFERENCE NUMERALS

1: rotary grindstone
2: central hole
3: reinforcing material
4: glass cloth
5: abrasive grain
6: prepreg
7: member to be ground
8: resin

The invention claimed is:

1. A manufacturing method of a rotary grindstone having a central hole for fitting a shaft for grindstone rotation drive of a grinder and attaching liquid resin to one or a plurality of sheets of glass cloth used as a reinforcing material to form a prepreg, attaching resin-coat abrasive grains having a largest intermediate circumference to the prepreg, wherein the glass cloth is weaved by thirl plain weave/twill weave or leno weave composed of twist yarns having a diameter of 0.1 mm and formed in meshes with lengthwise and crosswise lengths of 2.0 mm, and the rotary grindstone is manufactured by, after attaching liquid resin to the glass cloth to produce the prepreg, attaching resin-coat abrasive grains to both faces of the prepreg, and next after pressing the prepreg formed with resin-coat abrasive grains layers on both faces of the prepreg in a press and further performing predetermined press working in a metal mold, and after respective abrasive grains are conjugated with the lamest intermediate circumference of the resin-coat abrasive grains held in respective meshes of the glass cloth, performing baking in a baking furnace, wherein the resin-coat abrasive grains are held sufficiently to chip during grinding rather than fall off.

2. A method of manufacturing a rotary grindstone having a central hole comprising the steps of:

attaching a liquid resin to a glass cloth having a weave of twist yarns having a diameter of 0.1 mm and formed in meshes with lengthwise and crosswise lengths of 2.0 mm forming a prepreg having opposing faces;

pressing the prepreg with resin-coated abrasive grain layers on each of the opposing faces of the prepreg in a press wherein resin-coated abrasive grains of the resin-coated abrasive grain layers have a largest intermediate circumference and are wholly and firmly conjugated in the meshes, wherein the largest intermediate circumference of the resin coated abrasive grains are placed within the meshes and whereby a surface of the resin coated abrasive grains extend through the weave of the glass cloth; and baking the prepreg with resin-coated abrasive grain layers on each of the opposing faces, whereby the rotary grindstone is capable of self-sharpening since the resin-coated abrasive grains are held by the largest intermediate circumference in the meshes and chip rather than fall off so that sharp cutting faces appear, grinding resistance decreases and grinding heat is considerably lower.

3. A method of manufacturing a rotary grindstone as in claim 2 wherein:

the weave is selected from the group consisting of thirl plan weave, twill weave, and leno weave.

4. A rotary grindstone made according to the method of claim 2.

5. A rotary grindstone having a central hole comprising:

a glass cloth having a weave of twist yarns having a diameter of 0.1 mm and formed in meshes with lengthwise and crosswise lengths of 2.0 mm and opposing faces;

resin impregnating said glass cloth; and resin coated abrasive grains covering the opposing faces, with each of said resin coated abrasive grains having a largest intermediate circumference held and conjugated in the meshes of the weave of said glass cloth, wherein a surface of said resin coated abrasive grains extends through the meshes on the opposing faces of said glass cloth so as to chip during grinding, whereby the rotary grindstone is capable of self-sharpening since the resin-coated abrasive grains chip rather than fall off during grinding so that sharp cutting faces appear, grinding resistance decreases and grinding heat is considerably lower.

* * * * *